United States Patent [19]

Gogniat

[11] Patent Number: 4,637,734

[45] Date of Patent: Jan. 20, 1987

[54] WATCH CASE

[75] Inventor: Paul Gogniat, Bienne, Switzerland

[73] Assignee: Montres Rado S.A., Lengnau, Switzerland

[21] Appl. No.: 752,681

[22] Filed: Jul. 8, 1985

[30] Foreign Application Priority Data

Jul. 12, 1984 [CH] Switzerland ..... 3383/84

[51] Int. Cl.[4] ..... G04B 37/00

[52] U.S. Cl. ..... 368/294; 368/296

[58] Field of Search ..... 368/294–296

[56] References Cited

U.S. PATENT DOCUMENTS 4,327,429 4/1982 Klingenberg ..... 368/294

FOREIGN PATENT DOCUMENTS

| | | | |
|---|---|---|---|
| 67120 | 12/1982 | European Pat. Off. | 368/296 |
| 111449 | 6/1984 | European Pat. Off. | 368/296 |
| 2320589 | 3/1977 | France | 368/296 |
| 206230 | 7/1939 | Switzerland | 368/296 |
| 335158 | 12/1958 | Switzerland | 368/296 |
| 563611 | 1/1978 | Switzerland | 368/296 |

*Primary Examiner*—Bernard Roskoski

*Attorney, Agent, or Firm*—Sughrue, Mion, Zinn, Macpeak & Seas

[57] ABSTRACT

A case for a wrist watch includes a crystal, in particular, formed from a mineral material in the shape of a spherical cap which extends over the entire upper surface of the caseband and the edge of which descends to a level below that of the dial.

6 Claims, 5 Drawing Figures

WATCH CASE

This invention concerns a watch case comprising a caseband, a crystal formed of mineral material, the periphery of which rests on the caseband and covers it entirely and a back cover, these three elements defining a housing intended to receive a movement surmounted by a dial, and means for fastening the crystal to the caseband.

BACKGROUND OF THE INVENTION

Watch cases are already known in the prior art in which the crystal is directly fixed to the caseband. It has thus been proposed in the European published patent specification EP No. 0 066 538 to fasten a watch crystal by soldering, particularly one formed of a monocrystalline hard material such as sapphire, the periphery of such crystal being dimensioned to correspond to that of the caseband in a manner such that neither bezel nor fastening snap of the crystal to the caseband is necessary. According to this document, metallization layers cover a portion of the internal surface of the crystal in order to hide the solder and to assure its adhesion to the crystal. This method of fastening the crystal gives the case a novel and very elegant aesthetic to the extent that the caseband (or bezel) no longer surrounds the crystal. Since the crystal is preferably realized in a hard material such as sapphire, the most exposed parts of the case are thereby protected against scratch damage which might eventually occur.

It has long been known that the elegance of the watch is in large measure a function of its thickness, extra thin watches being generally those at the top of the quality range. In addition to their elegance, very thin watches are likewise more agreeable to wear to the extent that they are better integrated to the arm. The impression of thickness of a watch is not an entirely objective criterion, it being known that it is not solely a function of a measurable dimension at the center thereof, but also of the general form, i.e. the impression of thickness being largely conditioned by the height of the side face of the caseband. In fact, at the time of purchase of a watch, as far as the thickness is concerned, the criterion which counts for the most is not the measurable thickness, but the impression of thickness which the buyer perceives, and particularly the impression of thickness which the watch gives when worn. With this end in view, many cases exhibit a back cover extending below the level of the caseband in order to reduce the height of the side face of this latter. At the same time, if this artifice is exaggerated, it has as an effect to distance the caseband from the wrist when the watch is worn, being given that the surface of the wrist on which the back cover of the watch rests is slightly outwardly curved. This does not lead however to a better integration of the watch with the arm.

The purpose of this invention is thus to provide a solution which enables giving a watch case the impression of being apparently thinner than its real thickness, particularly when worn, and at the same time giving it more solidity and rendering it less vulnerable to the attacks to which it is daily subjected on the arm of the wearer.

In order to attain this purpose, the crystal has the form of an essentially spherical cap, of which at least a part of the periphery is situated at a level lower than that of the dial.

Publications are certainly known describing a watch case in which the crystal comprises a spherical surface or at least an outwardly curved surface, the periphery of which is at least partially at a level below that of the dial. Such may be found in particular in the French utility certificate FR No. 2 077 642 and French patent FR No. 1 398 410. In the watch cases which are described therein, the crystal is of an organic material and could only with difficulty be otherwise owing to the fact that the periphery thereof must be formed in order to obtain and assure the fastening of the crystal to the caseband. This necessitates moreover an extra thickness of the periphery in order to assure a good retention thereof.

It follows that the crystal is manufactured from an easily scratchable material. Moreover, the bevelling is limited.

In contrast thereto, the watch case according to the invention may present a side surface of the caseband reduced to a height just sufficient to prevent it from presenting a cutting edge. Thereby, with the crystal preferably formed of hard monocrystalline material, almost the only part of the case susceptible to shocks and scratches is realized from an unscratchable material. Moreover, thanks to its spherical cap form, the crystal enables better absorption of the shocks to which it may be subjected by transmission thereof to its seat situated on the caseband to which it is fastened (operation of a vault effect). Thus, in addition to the aesthetic effect which the solution presented by the invention confers to the watch case, it offers an excellent protection from shocks and pressures to which the watch is exposed. While extra thin watches have generally been de luxe watches of a relatively fragile nature, the solution proposed herein enables the combining of strength with great elegance. It is thus that such a watch having high resistance to pressure and external attacks may be worn without fear of deterioration in all circumstances of modern life and even in conditions as severe as may be encountered in subacquatic diving, even although it has not been especially conceived to this purpose.

A further advantage to take into consideration, deriving from the spherical cap form of the crystal, resides in the manner of manufacture thereof when it is of monocrystalline mineral material which, as is well known, may not simply be moulded as plastic watch glasses but on the contrary must be cut. A sample geometric form such as the spherical cap is easier to realize than known outwardly curved crystals having various radii of curvature, of the type intended to be fixed by a bezel or caseband snap for instance.

SUMMARY OF THE INVENTION

The invention therefore concerns a watch case comprising a caseband, a crystal of mineral material the peripheral part of which rests on the caseband and entirely covers it, and a back cover, each of these three elements comprising an outer surface and an inner surface which defines a receptacle intended to accommodate a movement surmounted by a dial and means for fastening the crystal to the caseband, the crystal having the form of a substantially spherical cap of which at least a part of the periphery is located at a level below that of the dial.

DESCRIPTION OF THE PREFERRED EMBODIMENT

Figure 2:
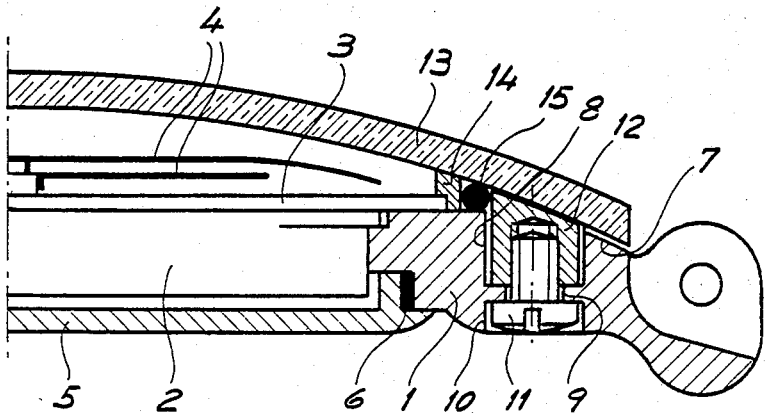
FIG. 2 is a sectional view along line II—II of FIG. 1.
Figure 1:
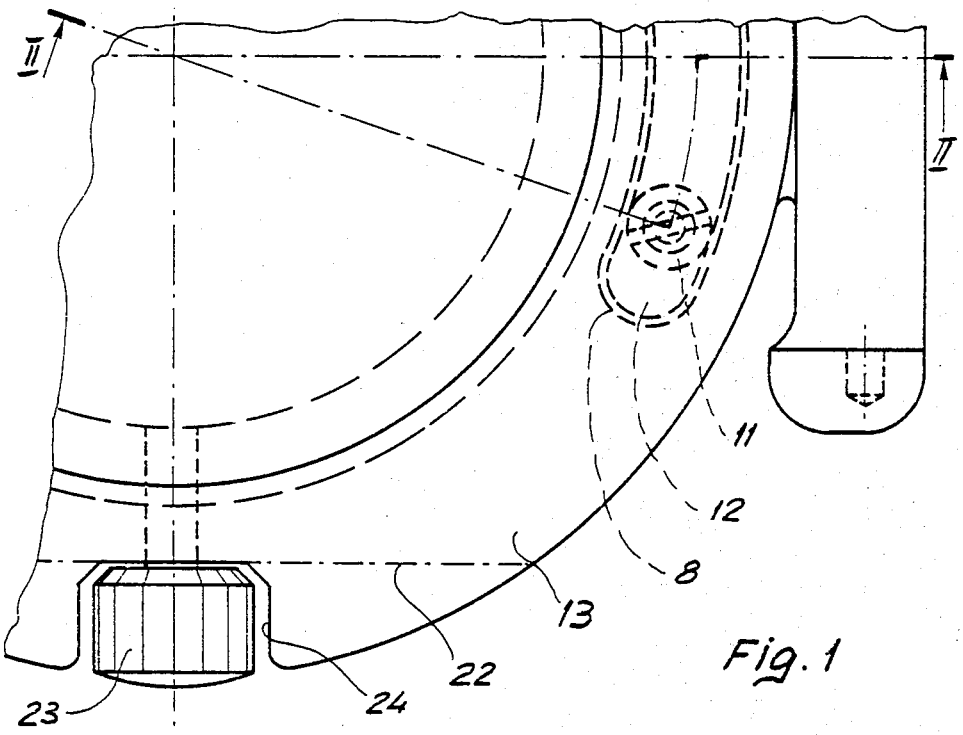
FIG. 1 is a partial view from above of a first variant of the invention.
Figure 3:
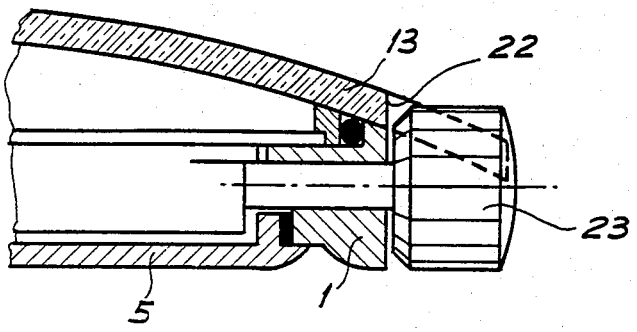
FIG. 3 is a sectional view along line III—III of FIG. 1.

FIGS. 1 to 3 represent a wrist-watch case comprising a caseband 1 of which the axial opening receives a timepiece movement 2 bearing a dial 3 and indicating hands 4. A back cover 5 is fastened to the caseband 1 with interposition of a seal 6. The upper surface 7 of the caseband has the form of a portion of a spherical surface of which the center is situated at the central axis of the case. This upper surface 7 presents two recesses 8 diametrically opposed and of which one only is shown on the drawing. Such recesses have the form of an annular segment. Each recess 8 provides two openings 9 (of which only one is visible on the drawing) situated in the neighbourhood of the respective extremities of the annular segment. Openings 9 each communicate with a clearing 10 situated in the under part of caseband 1 and intended to receive the head of a screw 11 screwed into a retaining member 12 in the form of an annular segment, such member being lodged in the bedding 8 and having its upper surface in the form of a portion of a sphere to be soldered to the internal surface of crystal 13. Advantageously the soldering of the crystal 13 to the retaining member 12 is realized by initially forming a first masking layer by metallization of an annular peripheral zone of the internal surface of the crystal through the physical deposition of a metal in the vapour phase, better known under the abbreviation "PVD". Next there is deposited a layer of chrome onto the first layer in order to stop diffusion of the solder and then a third adhesion layer for the solder such as a layer of copper or gold. These operations are for instance carried out as described in detail in the European patent application EP No. 0 066 538. Preferably crystal 13 is of a hard transparent mineral substance i.e. a material having a monocrystalline structure such as sapphire. On the drawing the edge of such crystal extends to the periphery of caseband 1. Taking into account its form of a spherical cap which is concentric to and of the same radius as the upper surface of caseband 1 the edge of the crystal completely covers the upper surface of such caseband and descends to a level which is below that of the lower surface of dial 3, in a manner such that the height of the lateral surface of the caseband is noticeably reduced.

Thus as may be more particularly seen on FIG. 3, crystal 13 covers the watch over more than the half of its thickness. Since moreover, the lateral surface of the caseband is concave, it is practically sheltered from scratching. The watch has thus in general the form of a convex lens.

Such watch further comprises a crown 23 for time setting (FIGS. 1 and 3) lodged in an opening 24 arranged in the caseband 1 and crystal 13. This crown 23 is advantageously made from or coated with a hard material which renders it less sensitive to scratching.

As a variant, not shown on the drawing, this watch may advantageously comprise time setting means coupled to the movement via the back cover 5 which would enable simplification of the exterior form of the watch.

The internal surface of crystal 13 in the form of a spherical cap presses a metallic ring 14 against the caseband 1 such ring presenting an annular cut-out receiving the edge of dial 3 and serving thus to maintain the movement in place. A seal 15 is disposed around ring 14 and serves to assure sealing between crystal 13 and caseband 1.

Figure 5:
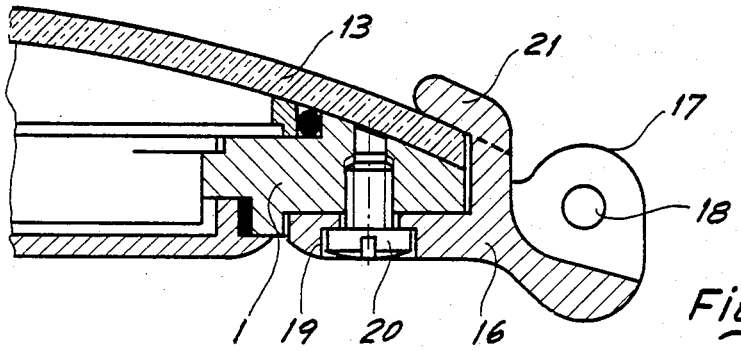
FIG. 5 is a cross-section along line V—V of FIG. 4.
Figure 4:
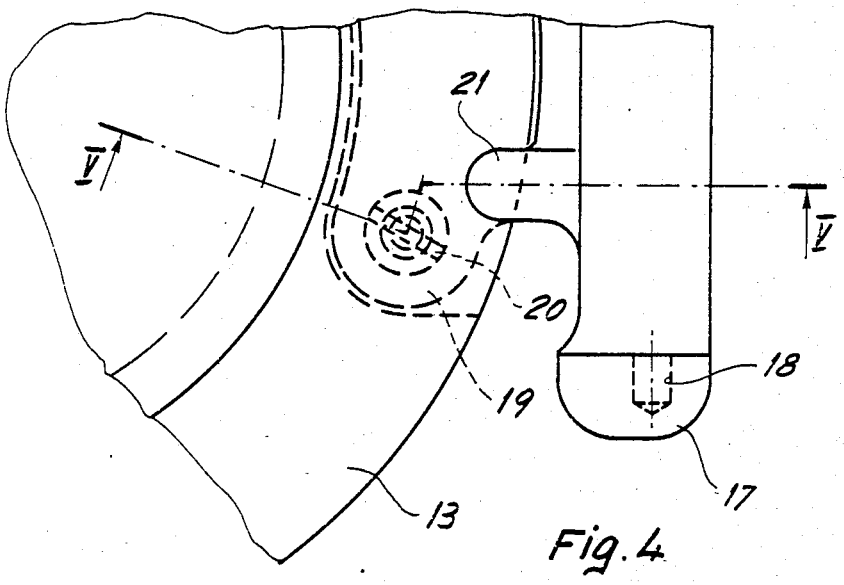
FIG. 4 is a partial view from above of a second variant.

The variant shown on FIGS. 4 and 5 is distinguished from the preceding essentially by the fact that crystal 13 is not fixed to caseband 1 by means of fastening members soldered to the crystal and screwed onto the caseband but rather by tightening. To this effect the watch case as shown comprises gripping members 16 of which one only is visible on the drawing. Each such member 16 exhibits two lugs 17, each provided with a blind hole 18 for the retention of a bar for the attachment of a bracelet and comprises a shoulder 19 fastened under the caseband by two screws 20 of which one only appears on the drawing. Each tightening member 16 presents moreover claws 21 which are applied against the periphery of the external surface of the crystal 13 and thus squeeze the internal surface against a portion of the upper surface of the caseband 1, this surface of the caseband having the form of a portion of a sphere of the same radius and the same center as the internal surface of crystal 13.

The rest of the case and the retention of the movement therein are identical to the variant of FIG. 1 and will thus not be further described.

Although in this variant the crystal is not soldered, the peripheral zone of its internal surface situated at the exterior of ring 14 may be advantageously metallized in order to hide this portion of the caseband.

Although provided with a crystal in the form of a spherical cap, the watch case as described is not necessarily circular. It may thus be as shown as a variant of FIG. 1, that the caseband and the crystal could be cut along the chord shown by dot-dash line 22, a symmetrical cut (not shown on the drawing) being realized on the diametrically opposed side of the case parallel to dot-dash line 22.

What I claim is:

1. A watch case comprising a caseband, a crystal of mineral material the peripheral part of which rests on the caseband and entirely covers it, and a back cover, each of these three elements comprising an outer surface and an inner surface which defines a receptacle intended to accommodate a movement surmounted by a dial, and means for fastening the crystal to the caseband, wherein the inner and outer surfaces of the crystal are both entirely defined by a sphere portion, and at least a part of the crystal periphery is located at a level below that of the dial.

2. A watch case as set forth in claim 1 in which said fastening means comprise threaded feet soldered to the inner surface of the crystal and lodged in openings arranged in the upper surface of the caseband and tightening screws respectively engaged with said feet and through passages connecting the bottom of said openings to the lower surface of the caseband.

3. A watch case as set forth in claim 1 wherein said fastening means are each formed by a shoulder fixed to the lower surface of the caseband and by claws projecting over said shoulder and engaging the periphery of the outer surface of the crystal.

4. A watch case as set forth in claim 3 wherein said fastening means comprise two shoulders symmetrically arranged on either side of the caseband, each of said shoulders being furthermore fixed to elements for attaching a bracelet.

5. A watch case as set forth in claim 1 wherein said mineral material is a monocrystaline sapphire.

6. A watch case as set forth in claim 1 the thickness of which is defined by the maximum distance between the outer surface of the crystal and the back cover and wherein at least half of such thickness is occupied by said crystal.

* * * * *